US006018875A

United States Patent [19]

Miranda

[11] Patent Number: 6,018,875

[45] Date of Patent: Feb. 1, 2000

[54] SHEET METAL SHEARS

[76] Inventor: Fernando J. Miranda, 104 - Arapaho Trail, Branchburg, N.J. 08876

[21] Appl. No.: 09/168,485

[22] Filed: Oct. 8, 1998

[51] Int. Cl.[7] ..... B26B 29/04

[52] U.S. Cl. ..... 30/233; 30/254; 30/295

[58] Field of Search ..... 30/232, 233, 191, 30/193, 287, 291, 295, 254

[56] References Cited

U.S. PATENT DOCUMENTS

| | | | |
|---|---|---|---|
| 499,705 | 6/1893 | Blake | 30/233 |
| 784,978 | 3/1905 | Broadbooks | 30/233 |
| 1,272,123 | 7/1918 | Schell | 30/233 |
| 3,046,655 | 7/1962 | Sproson | 30/233 |
| 4,209,901 | 7/1980 | Hemingway | 30/233 |
| 4,235,016 | 11/1980 | Kobelt | 30/233 |
| 5,060,381 | 10/1991 | Taberlet | 30/232 |

*Primary Examiner*—M. Rachuba
*Assistant Examiner*—Ana Luna

[57] ABSTRACT

A sheet metal shears for protecting from injury the hand of a user holding the sheet metal shears while cutting a piece of sheet metal. The tool includes sheet metal shears having a pair arms pivotally coupled together with each arm having a cutting blade and a lever handle. The lever handle of one of the arms has a closed finger loop distal the cutting blade of the one arm. The lever handle of the other arm has a generally U-shaped open finger loop distal the cutting blade of the other arm. The open finger loop has a pair of space apart elongate portions and an arcuate portion connecting the elongate portions of the open finger loop together. A first of the elongate portions connects the open finger loop to the lever handle of the other arm. A second elongate portion has an arcuate region for forcing a portion of the sheet metal cut by the cutting blades away from the open finger loop to protect the hand of the user from injury from the cut edges of the sheet metal while the user is cutting the sheet metal.

5 Claims, 2 Drawing Sheets

SHEET METAL SHEARS

BACKGROUND OF THE INVENTION

1. Field of the Invention

The present invention relates to sheet metal shears and more particularly pertains to a new sheet metal shears for protecting from injury the hand of a user holding the sheet metal shears while cutting a piece of sheet metal.

2. Description of the Prior Art

The use of sheet metal shears is known in the prior art. More specifically, sheet metal shears heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,209,901; U.S. Pat. No. 5,379,521; U.S. Pat. No. Des 101,791; U.S. Pat. No. 4,235,016; U.S. Pat. No. 2,272,753; and U.S. Pat. No. 5,297,342.

While these devices fulfill their respective, particular objectives and requirements, the aforementioned patents do not disclose a new sheet metal shears. The inventive device includes sheet metal shears having a pair arms pivotally coupled together with each arm having a cutting blade and a lever handle. The lever handle of one of the arms has a closed finger loop distal the cutting blade of the one arm. The lever handle of the other arm has a generally U-shaped open finger loop distal the cutting blade of the other arm. The open finger loop has a pair of space apart elongate portions and an arcuate portion connecting the elongate portions of the open finger loop together. A first of the elongate portions connects the open finger loop to the lever handle of the other arm. A second elongate portion has an arcuate region for forcing a portion of the sheet metal cut by the cutting blades away from the open finger loop to protect the hand of the user from injury from the cut edges of the sheet metal while the user is cutting the sheet metal.

In these respects, the sheet metal shears according to the present invention substantially departs from the conventional concepts and designs of the prior art, and in so doing provides an apparatus primarily developed for the purpose of protecting from injury the hand of a user holding the sheet metal shears while cutting a piece of sheet metal.

SUMMARY OF THE INVENTION

In view of the foregoing disadvantages inherent in the known types of sheet metal shears now present in the prior art, the present invention provides a new sheet metal shears construction wherein the same can be utilized for protecting from injury the hand of a user holding the sheet metal shears while cutting a piece of sheet metal.

The general purpose of the present invention, which will be described subsequently in greater detail, is to provide a new sheet metal shears apparatus and method which has many of the advantages of the sheet metal shears mentioned heretofore and many novel features that result in a new sheet metal shears which is not anticipated, rendered obvious, suggested, or even implied by any of the prior art sheet metal shears, either alone or in any combination thereof.

To attain this, the present invention generally comprises sheet metal shears having a pair arms pivotally coupled together with each arm having a cutting blade and a lever handle. The lever handle of one of the arms has a closed finger loop distal the cutting blade of the one arm. The lever handle of the other arm has a generally U-shaped open finger loop distal the cutting blade of the other arm. The open finger loop has a pair of space apart elongate portions and an arcuate portion connecting the elongate portions of the open finger loop together. A first of the elongate portions connects the open finger loop to the lever handle of the other arm. A second elongate portion has an arcuate region for forcing a portion of the sheet metal cut by the cutting blades away from the open finger loop to protect the hand of the user from injury from the cut edges of the sheet metal while the user is cutting the sheet metal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sheet metal shears apparatus and method which has many of the advantages of the sheet metal shears mentioned heretofore and many novel features that result in a new sheet metal shears which is not anticipated, rendered obvious, suggested, or even implied by any of the prior art sheet metal shears, either alone or in any combination thereof.

It is another object of the present invention to provide a new sheet metal shears which may be easily and efficiently manufactured and marketed.

It is a further object of the present invention to provide a new sheet metal shears which is of a durable and reliable construction.

An even further object of the present invention is to provide a new sheet metal shears which is susceptible of a low cost of manufacture with regard to both materials and labor, and which accordingly is then susceptible of low prices of sale to the consuming public, thereby making such sheet metal shears economically available to the buying public.

Still yet another object of the present invention is to provide a new sheet metal shears which provides in the apparatuses and methods of the prior art some of the advantages thereof, while simultaneously overcoming some of the disadvantages normally associated therewith.

Still another object of the present invention is to provide a new sheet metal shears for protecting from injury the hand of a user holding the sheet metal shears while cutting a piece of sheet metal.

Yet another object of the present invention is to provide a new sheet metal shears which includes sheet metal shears having a pair arms pivotally coupled together with each arm having a cutting blade and a lever handle. The lever handle of one of the arms has a closed finger loop distal the cutting blade of the one arm. The lever handle of the other arm has a generally U-shaped open finger loop distal the cutting blade of the other arm. The open finger loop has a pair of space apart elongate portions and an arcuate portion connecting the elongate portions of the open finger loop together. A first of the elongate portions connects the open finger loop to the lever handle of the other arm. A second elongate portion has an arcuatc region for forcing a portion of the sheet metal cut by the cutting blades away from the open finger loop to protect the hand of the user from injury from the cut edges of the sheet metal while the user is cutting the sheet metal.

Still yet another object of the present invention is to provide a new sheet metal shears that has an open handle loop that provides more maneuverability and comfort to a user while cutting sheet metal and which also forces the cut portion of the sheet metal in a direction away from the hand of the user to prevent injury to the user from the cut edges of the sheet metal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
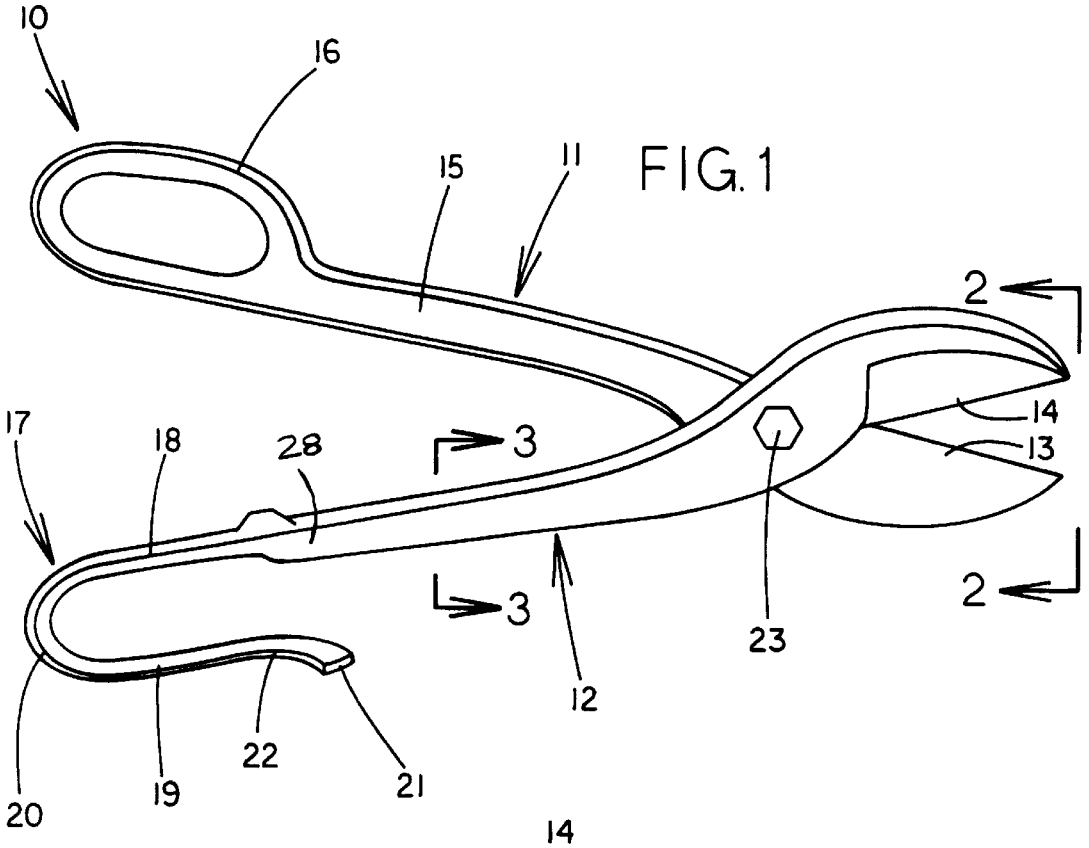
FIG. 1 is a schematic top side view of a new sheet metal shears according to the present invention.
Figure 2:
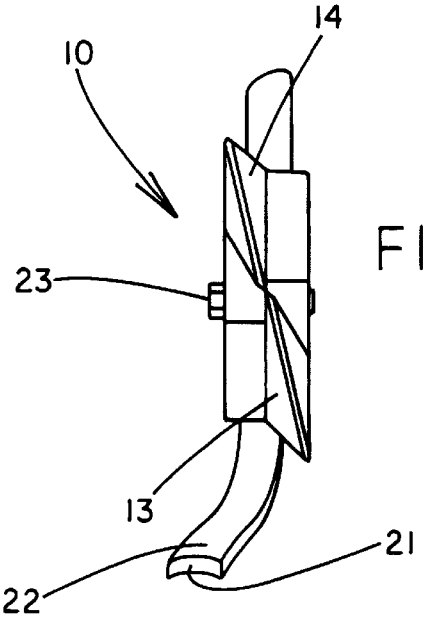
FIG. 2 is a schematic front end view of the present invention as seen from line 2—2 of FIG. 1.

With reference now to the drawings, and in particular to FIGS. 1 through 4 thereof, a new sheet metal shears embodying the principles and concepts of the present invention and generally designated by the reference numeral 10 will be described.

As best illustrated in FIGS. 1 through 4, the sheet metal shears 10 generally comprises sheet metal shears 10 having a pair arms 11,12 pivotally coupled together with each arm 11,12 having a cutting blade 13,14 and a lever handle 15,28. The lever handle 15 of one of the arms 11 has a closed finger loop 16 distal its cutting blade 13. The lever handle 28 of the other arm 12 has a generally U-shaped open finger loop 17 distal its cutting blade 14. The open finger loop 17 has a pair of space apart elongate portions 18,19 and an arcuate portion 20 connecting the elongate portions 18,19 of the open finger loop 17 together. A first of the elongate portions 18 connects the open finger loop 17 to the lever handle of the other arm. A second elongate portion 19 has an arcuate region 22 for forcing a portion of the sheet metal cut by the cutting blades 13,14 away from the open finger loop 17 to protect the hand of the user from injury from the cut edges of the sheet metal while the user is cutting the sheet metal.

In closer detail, the sheet metal shears have a pair arms 11,12 pivotally coupled together by a pivot coupling 23. Each arm 11,12 has a conventional sheet metal cutting blade 13,14 and a lever handle 15,28. The lever handle 15 of one of the arms 11 has a closed finger loop 16 distal its cutting blade 13. The closed finger loop 16 is adapted for extending a thumb or fingers of a user therethrough. The closed finger loop 16 and the lever handle 15 of the one arm 11 lie in a generally common plane such that the closed finger loop 16 and the lever handle 15 are generally coplanar.

The lever handle 28 of the other arm 12 has a generally U-shaped open finger loop 17 distal its cutting blade 14. The open finger loop 17 has a pair of space apart elongate portions 18,19 and an arcuate portion 20 connecting the elongate portions 18,19 together. A first of the elongate portions 18 connects the open finger loop 17 to the lever handle 28. The first elongate portion 18 and the arcuate portion 20 of the open finger loop 17 and the lever handle 28 lie in a generally common plane such that the first elongate portion 18 and the arcuate portion 20 of the open finger loop 17 and the lever handle 28 are generally coplanar and lying in a plane generally parallel to the plane of the closed finger loop 16.

A second of the elongate portions 19 of the open finger loop 17 terminates at a tip 21. The second elongate portion 19 has an arcuate region 22 curving in a direction away from the common plane of the first elongate portion 18 and the arcuate portion 20 of the open finger loop 17 and in a direction away from the lever handle 28 such that the tip 21 of the open finger loop 17 extends outwardly from the common plane of the one elongate portion 18 and away from the lever handle 28. The arcuate region 22 defines an arc length having a radius and an arc angle (indicated by $\alpha$) Preferably, the arc angle ($\alpha$) is between about 15° and about 120°. Ideally the arc angle is about 75°.

In use, when the user holds the sheet metal shears 10 with the open finger loop 17 facing towards the sheet metal, the arcuate region 22 extends away from the shears and towards the sheet metal and laterally outwards away from the user. The arcuate region 22 is adapted for forcing a portion of the sheet metal cut by the cutting blades 13,14 away from the open finger loop 17 to protect the hand of the user from injury from the cut edges of the sheet metal while the user is cutting the sheet metal.

Figure 3:
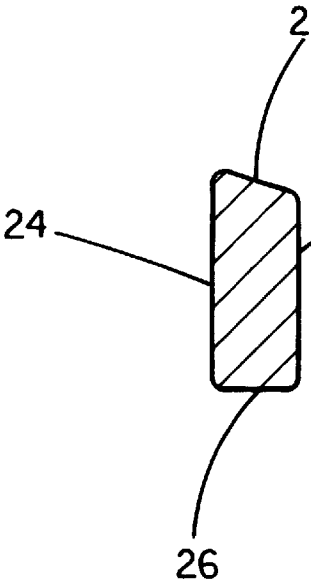
FIG. 3 is a schematic cross sectional view of the present invention taken from line 3—3 of FIG. 1.
Figure 4:
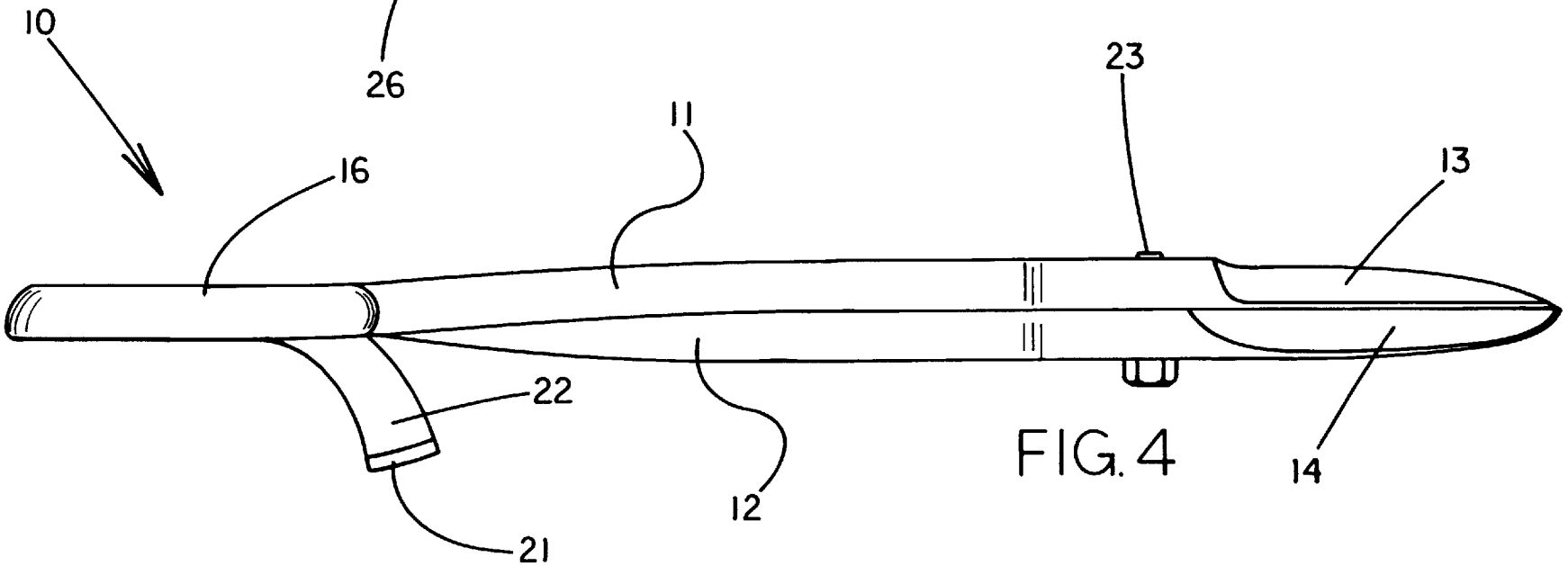
FIG. 4 is another schematic side view of the present invention.

In an ideal embodiment as illustrated in FIG. 3, the lever handle 28 may has a beveled side 27 such that a cross section of the lever handle of the other arm has a pair of parallel sides 24,25 and a third side 26 extending generally perpendicular to the pair of parallel sides with the fourth side 27 extending at an acute angle with respect to the third side 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for cutting a sheet of metal, comprising:

sheet metal shears having a pair of arms pivotally coupled together, each arm having a cutting blade and a lever handle;

said lever handle of a first one of said arms having a closed finger loop distal said cutting blade of said first arm;

said lever handle of a second one of said arms having a generally U-shaped open finger loop distal said cutting blade of said second arm;

said open finger loop having a pair of spaced apart elongate portions and an arcuate portion connecting said elongate portions of said open finger loop together;

a first of said elongate portions connecting said open finger loop to said lever handle of said second arm;

a second of said elongate portions of said open finger loop terminating at tip;

said second elongate portion having an arcuate region adjacent said tip for forcing a portion of the select metal cut by said cutting blades away from the open finger loop to protect the hand of the user from injury from the cut edges of the sheet metal while the user is cutting the sheet metal;

said first elongate portion and said arcuate portion of said open finger loop and said lever handle of said second arm lying in a generally common plane such that said first elongate portion and said arcuate portion of said open finger loop and said lever handle of said second arm are generally coplanar; and wherein said arcuate region curves in a direction away from the common plane of said first elongate portion and said arcuate portion of said open finger loop and in a direction away from said lever handle of said second arm such that said tip of said open finger loop extends outwardly from said common plane of said one elongate portion and away from said lever handle of said second arm.

2. The tool of claim 1, wherein said arcuate region defines an arc length having a radius and an arc angle, wherein said arc angle is between about 15° and about 120°.

3. The tool of claim 2, wherein said arc angle is about 750°.

4. The tool of claim 1, wherein said closed finger loop and said lever handle of said first arm lie in a generally common plane such that said closed finger loop and said lever handle of said first arm are generally coplanar, wherein said closed finger loop and said first elongate portion and said arcuate portion of said open finger loop lie in generally parallel planes to one another.

5. A tool for cutting a sheet of metal, comprising:

sheet metal shears having a pair of arms pivotally coupled together, each arm having a cutting blade and a lever handle;

said lever handle of a first one of said arms having a closed finger loop distal said cutting blade of said first arm;

said closed finger loop and said lever handle of said first arm lying in a generally common plane such that said closed finger loop and said lever handle of said first arm are generally coplanar;

said lever handle of a second one of said arms having a generally U-shaped open finger loop distal said cutting blade of said second arm;

said open finger loop having a pair of spaced apart elongate portions and an arcuate portion connecting said elongate portions of said open finger loop together;

a first of said elongate portions connecting said open finger loop to said lever handle of said second arm;

said first elongate portion and said arcuate portion of said open finger loop and said lever handle of said second arm lying in a generally common plane such that said first elongate portion and said arcuate portion of said open finger loop and said lever handle of said second arm are generally coplanar, said closed finger loop and said first elongate portion and said arcutate portion of said open finger loop lying in generally parallel planes to one another;

a second of said elongate portions of said open finger loop terminating at tip;

said second elongate portion having an arcuate region curving in a direction away from the common plane of said first elongate portion and said arcuate portion of said open finger loop and in a direction away from said lever handle of said second arm such that said tip of said open finger loop extends outwardly from said common plane of said one elongate portion and away from said lever handle of said second arm, said arcuate region defining an arc length having a radius and an arc angle, wherein said arc angle is between about 15° and about 120°; and said arcuate region being adapted for forcing a portion of the sheet metal cut by said cutting blades away from the open finger loop to protect the hand of the user from injury from the cut edges of the sheet metal while the user is cutting the sheet metal.

* * * * *